United States Patent [19]

Crook

[11] 4,415,532

[45] Nov. 15, 1983

[54] COBALT SUPERALLOY

[75] Inventor: Paul Crook, Kokomo, Ind.

[73] Assignee: Cabot Corporation, Kokomo, Ind.

[21] Appl. No.: 240,642

[22] Filed: Mar. 5, 1981

[51] Int. Cl.[3] ..... C22C 30/00

[52] U.S. Cl. ..... 420/585; 148/442; 420/582; 420/586

[58] Field of Search ..... 75/122, 134 F, 171; 148/32

[56] References Cited

U.S. PATENT DOCUMENTS 2,974,037 3/1961 Thielemann ..... 75/171

*Primary Examiner*—R. Dean

*Attorney, Agent, or Firm*—Jack Schuman; Joseph J. Phillips

[57] ABSTRACT

Disclosed is a cobalt-base superalloy containing about 32% cobalt, 8% nickel, 26.5% chromium, 2.5% tungsten, 5% niobium, about 1% each manganese and silicon, about 0.4% carbon, and the balance about 23% iron plus incidental impurities and modifiers normally found in alloys of this class. The alloy is readily processed in the form of wrought products, castings, metal powder and all forms of welding and hardfacing materials. The outstanding characteristics of the new alloy include the resistance to cavitation erosion and galling, low cost and minimal use of strategic metals.

5 Claims, No Drawings

COBALT SUPERALLOY

This invention relates to cobalt-chromium-iron superalloys and, more specifically, to a Co-Cr-Fe alloy available in a variety of forms and especially suited for use in severe service conditions because of a valuable combination of properties.

BACKGROUND

The art and science of present day superalloys has undergone a very interesting history. From a practical view point, the early alloys of Elwood Haynes (circa 1905) constituted the basic origin of the modern cobalt-chromium superalloys, under the trademark "STELLITE". His alloys were originally covered by U.S. Pat. Nos. 873,745, 1,057,423 and others. About thirty years later, Charles H. Prange invented a somewhat similar cobalt-base alloy for use as cast metal dentures and prosthetics as disclosed in U.S. Pat. Nos. 1,958,446, 2,135,600 and others. Prange's alloy is known in the art as "Vitallium" alloy.

The development of gas turbine engines in the early 1940's, created a need for materials capable of withstanding high forces at high temperatures. U.S. Pat. No. 2,381,459 discloses the discovery of Prange's "Vitallium" alloys modified for use as gas turbine engine components. The major commercial alloy developed from the original "Vitallium" alloy is STELLITE® alloy No. 21 essentially as disclosed in U.S. Pat. No. 2,381,459 and 2,293,206 to meet high temperature demands in industry. The basic composition of alloy 21 has been modified and further developed into many other commercial superalloys because of the need for improvements to meet more severe conditions required in gas turbine engines and other modern uses.

There have been hundreds of cobalt-and-nickel base alloys invented and developed for these uses. This vital need continues today. From a practical view, even minor advances in more sophisticated engines are in most cases principally limited by the availability of materials capable of withstanding the new, and more severe, demands.

A careful study of the many valuable alloys that are invented reveals that a subtle, seemingly ineffective, modification of existing alloys may provide a new and useful alloy suited for certain specific uses. Such modifications include, for example, (1) a new maximum limit of a known impurity; (2) a new range of an effective element; (3) a critical ratio of certain elements already specified; and the like. Thus, in superalloy developments valuable advances are not necessarily made by great strides of new science or art, but rather by small unexpected, but effective increments.

People skilled in the superalloy arts are constantly reviewing the known problems and evaluating the known alloys. In spite of this, many problems remain unsolved for several decades until an improved alloy must be invented to solve the problem. Such improvement, however seemingly simple in hindsight, cannot be assumed to be obvious or mere extention of known art.

PRIOR ART

In view of the hundreds of known alloys available, there has been a need for an alloy suitable for hardfacing operations with a valuable combination of properties. Such a combination of properties as metal to metal (galling) resistance, hot hardness, toughness, cavitation erosion resistance and corrosion resistance is required in certain specific engineering systems such as globe and gate valves for steam and fluid control. Many patents have disclosed alloys that feature one or more of these and other properties to an outstanding degree. Table 1 lists a number of prior art patents and alloys that disclose essentially cobalt-rich alloys containing chromium and modifying elements. Also of interest are: U.S. Pat. No. 2,713,537 disclosing low chromium, high vanadium and carbon alloys; U.S. Pat. No. 2,397,034 disclosing S-816 alloy a low chromium high nickel alloy; U.S. Pat. No. 2,983,603 disclosing S-816 alloy of 2,397,034 plus titanium and boron additives; U.S. Pat. No. 2,763,547 listed in Table 1 also discloses a variation of the alloy of U.S. Pat. No. 2,397,034. U.S. Pat. No. 2,947,036 discloses the alloy of U.S. Pat. No. 2,974,037 plus tantalum and zirconium modifications; U.S. Pat. Nos. 2,135,600 and 2,180,549 disclose variations of tungsten-and-molybdenum-rich alloys essentially as disclosed in U.S. Pat. No. 1,958,446. Known in the art, as mentioned hereinbefore is Alloy 21 "Vitallium". This alloy has been used for over 30 years in severe service conditions, for example as a gas turbine engine component (U.S. Pat. No. 2,381,459).

Each of these known alloys, generally composed of iron-cobalt-nickel-tungsten and/or molybdenum-chromium, has a number of desirable engineering characteristics. However, none has the valuable combination of properties recited above: metal to metal (galling) resistance, hot hardness, toughness, cavitation erosion resistance, and corrosion resistance, together with low cobalt and strategic metal contents and availability in many forms including hardfacing consumables, castings, plate and sheet.

OBJECTIONS OF THE INVENTION

It is a principal object of this invention to provide a superalloy with an outstanding combination of properties including metal to metal (galling) resistance, hot hardness, toughness, cavitation erosion and corrosion resistance.

It is another principal object of this invention to provide an improved superalloy at a lower cost and lower use of strategic metals: including cobalt, tantalum, tungsten, etc.

It is still another object of this invention to provide an improved superalloy capable of being produced in many forms including, i.e. cast, wrought, powder and as materials for hardfacing.

Other objectives and benefits are provided by the alloy of this invention as disclosed in Table 2 and Table 2-A.

THE ALLOY OF THIS INVENTION

It was discovered as part of the invention, that not only the elements must be present in the ranges given in Table 2 but also there must be a minimum of chromium plus cobalt and there must be a required ratio between niobium and chromium.

DISCUSSION OF INVENTION

Alloys designed to resist wear comprise, in general, two constituents; a hard phase dispersion, which is commonly carbide or boride, and a strong metallic matrix.

Abrasive wear and low angle solid particle impingement erosion would appear to be controlled predominantly by the volume fraction and morphology of the hard phase dispersion. Metal to metal wear and other types of erosion would appear to be more dependent upon the properties of the metallic matrix.

The alloys of this invention were designed to resist metal to metal wear (galling) and cavitation erosion, as might be experienced in valve applications, at both room and elevated temperatures. In the alloys, therefore, the hard phase volume fraction and morphology are optimised in terms of their effect upon bulk strength and ductility rather than their effect upon abrasion and low angle solid particle erosion resistance.

The matrix of the alloys is based upon a particular moderate cost combination of cobalt, iron and nickel and strengthened by high levels of chromium and moderate quantities of the solutes tungsten and molybdenum.

The traditional alloys based on cobalt feature a dispersion of carbides, chiefly $Cr_7C_3$, which forms during solidification. A quantity of chromium, which provides not only strength, but also corrosion resistance to the matrix, is used up therefore during formation of the hard phase. In the alloys of the invention, niobium and tantalum are used. Not only do these elements form carbides ahead of chromium, thus releasing most of the chromium to the matrix for strengthening and corrosion protection purposes, they also promote the formation of a fine dispersion of equiaxed particles, ideal from a strength and ductility viewpoint.

Cobalt

Gives deformation and fracture resistance to the matrix at both room and elevated temperatures through its influence upon SFE and the associated stress-induced HCP transformation/twin behavior. Below 28 wt.% it is believed that the resistance to deformation and fracture would be reduced appreciably. Above 36 wt.%, it is believed that the ductility would be reduced.

Nickel

Protects the alloy from body centered cubic transformation following iron dilution during arc welding. Too little, it is believed, gives no protection. Too much, it is believed, modifies the deformation and fracture characteristics of the matrix through its influence on SFE.

IRON

Balance

Carbon

Too little would give material of reduced strength and release niobium to matrix modifying its properties. Too much would result in an unsuitable duplex hard phase.

Niobium

Too little would result in chromium combining also with carbon thus weakening the matrix. Too much would result in a solid solution of modified properties.

Chromium

Strengthens the matrix and provides corrosion and oxidation protection. Too little results in too low a matrix strength and too little resistance to aggressive media. Too much results, it is believed, in a reduction in ductility.

Tungsten

Strengthens matrix. Same argument.

Silicon

Provides fluidity. Too little results in poor castability/weldability. Too much can promote the formation of intermetallics in the matrix.

Manganese

To protect against hot tearing following the coating of steel substrates. Too little results in no protection. Too much results in modified matrix behavior.

EXAMPLES AND TESTING

The alloy of this invention was produced by a variety of processes. Table 2-A lists the compositions of representative alloys prepared for testing.

Alloy 2008-D and 2008-E produced as bare welding rods. Test data were obtained from depositions of the welding rods in the "as cast" condition unless otherwise indicated.

Alloy 2008-C was produced as castings by the "lost wax" investment casting process. The specimens generally had a nominal surface area of 30 sq. cm and were in the "as cast" shot blasted condition after examination by X-ray methods.

Alloy 2008-W was produced by wrought processing as described herein.

The alloy of this invention was produced and tested in other forms, for example, coated welding electrodes as used in the manual metal arc process. The alloy of this invention may be produced in the form of rods, wires, metal powder and sintered metal powder objects. The general characteristics of fluidity, ductility, general working properties and the like suggest that the alloy may be readily produced in all other forms with no problems in processing.

TABLE 1

| | PRIOR ART ALLOYS | | | | | EXPERIMENTAL ALLOYS | |
|---|---|---|---|---|---|---|---|
| | U.S. PAT. NO. | | | | | | |
| | 2,214,810 | 2,763,547 | 2,974,037 | 1,958,446 | 2,392,821 | Alloy 21 | Alloy 721 |
| C | 1.75-2.75 | .10-.70 | .1-1.3 | 1 max | .5-1.5 | .25 | .40 |
| Co | 35-55 | 30-70 | Bal | Bal | — | Bal | 6.5 |
| Ni | Ni + Co 35-55 | 0-22 | 5 max | 40 max | over 30 | 2.8 | Bal |
| Cr | 25-45 | 18-30 | 15-30 | 10-40 | 10-30 | 27.0 | 17.0 |
| W + Mo | 10-20 | 2-6 Mo<br>2-6 W | 5-15<br>3.5 Mo max | 5 max | 10 max W<br>5-25 Mo | 5 Mo | 4.5 W |
| Nb + Ta | — | 2-6 | .5-5 Nb<br>Nb + Ta-20 max | Ta 5 max | — | — | — |
| Si | about .25 | 1 max | 1.5 max | 1 max | — | — | 1 max |
| Mn | .5-.75 | 2 max | — | 1 max | — | — | 1 max |
| Co + Cr | 60-100 | 40-100 | — | — | — | Bal | 23.5 |

TABLE 1-continued

| | PRIOR ART ALLOYS | | | | | EXPERIMENTAL ALLOYS | |
|---|---|---|---|---|---|---|---|
| | U.S. PAT. NO. | | | | | | |
| | 2,214,810 | 2,763,547 | 2,974,037 | 1,958,446 | 2,392,821 | Alloy 21 | Alloy 721 |
| $\frac{Nb}{Cr}$ | — | $\frac{1}{15}-\frac{1}{3}$ | $\frac{1}{60}-\frac{1}{3}$ | — | — | Bal | 23.5 |
| Al + Cu + Ti + V + Zr + Hf | up to 6 Ti | — | — | — | — | — | — |
| P | — | — | — | — | — | — | — |
| A | — | — | — | — | — | — | — |
| B | .10–.28 | .6–1.3 | .01–.2 | — | — | — | — |
| Fe | Bal (about 5) | 7 max | 5 max | 25 max | 35 max | 2 max | 5.5 max |

TABLE 2

| ALLOY OF THIS INVENTION, IN WEIGHT PERCENT, w/o | Broad Range | Preferred Range | Typical Alloy |
|---|---|---|---|
| Carbon | 0.2 to 0.6 | 0.2 to 0.6 | .4 |
| Cobalt | 25 to 36 | 25 to 36 | 32 |
| Nickel | 3.5 to 10 | 3.5 to 10 | 8 |
| Chromium | 24 to 30 | 25 to 29 | 26.5 |
| W + Mo | 1 to 5 | 1.5 to 5 | 2.5 W |
| Nb + Ta | 2 to 9 | 3 to 7 | 5 Nb |
| Silicon | .5 to 2.0 | .5 to 1.5 | 1.0 |
| Manganese | up to 2 | .45 to 1.5 | 1.0 |
| Co + Cr | 55 min. | 55 min. | 58.5 |
| $\frac{Nb}{Cr}$ Ratio | $\frac{1}{3.5}$ to $\frac{1}{6.5}$ | $\frac{1}{4}$ to $\frac{1}{6}$ | $\frac{1}{5}$ |
| Al + Cu + Ti + V + Zr + Hf | up to 2 | up to 2 | up to 2 |
| P | .01 max | .01 max | .01 max |
| S | .01 max | .01 max | .01 max |
| B | up to .2 | up to .1 | up to .1 |
| Iron Plus Impurities | Balance | Balance | about 23–Balance |

TABLE 2-A

| EXAMPLE ALLOYS OF THIS INVENTION In Weight Percent | Alloy 2008-D | Alloy 2008-E | Alloy 2008-C | Alloy 2008-W |
|---|---|---|---|---|
| Carbon | 0.49 | .40 | .39 | .43 |
| Cobalt | 32.5 | 32.0 | 31.38 | 30.15 |
| Nickel | 8.02 | 8.0 | 8.0 | 9.01 |
| Chromium | 26.27 | 26.5 | 26.93 | 27.01 |
| W + Mo | 2.58 | 2.5 | 2.69 | 2.29 |
| Nb + Ta | 4.88 | 5.0 | 5.01 | 4.98 |
| Silicon | .56 | 1.0 | 1.22 | 1.05 |
| Manganese | .50 | 1.0 | 1.03 | .97 |
| Co + Cr | 58.77 | 58.5 | 58.31 | 57.16 |
| $\frac{Nb}{Cr}$ | about $\frac{1}{5.4}$ | about $\frac{1}{5.2}$ | about $\frac{1}{5.3}$ | about $\frac{1}{5.4}$ |
| Al + Cu + Ti + V + Zr + Hf | 2.0 max | 2 max | 2 max | 2 max |

TABLE 2-A-continued

| EXAMPLE ALLOYS OF THIS INVENTION In Weight Percent | Alloy 2008-D | Alloy 2008-E | Alloy 2008-C | Alloy 2008-W |
|---|---|---|---|---|
| Phosphorous | .01 max | .01 max | .01 max | .01 max |
| Sulfur | .01 max | .01 max | .01 max | .01 max |
| Iron + Impurities | about 24 | about 23 | about 23 | about 23 |

Wrought Products

The alloy of this invention was produced as a wrought product. The alloy consisted of 30.15% cobalt, 9.01% nickel, 0.43% carbon, 27.01% chromium, 2.29% tungsten, 1.05% silicon, 0.97% manganese, 4.98% niobium and the balance (about 24%) iron. Fifty pounds of alloy was vacuum induction melted and ESR electroslag remelted into an ingot. The ingot was hot forged and rolled at 2250° F. into plate and sheet and stress relieved for 30 minutes and 10 to 15 minutes respectively. The plate thickness was 0.6 inch and the sheet thickness was 0.055 inch.

Rockwell hardness readings were obtained as follows:

as forged: 26 Rc
stress relieved plate: 25 Rc
as rolled sheet: 36 Rc
stress relieved sheet: 96 Rb
Heated treated 8 hours at 1500° F.
stress relieved sheet: 32 Rc Hot hardness data have been obtained on examples of the alloy of this invention, Alloy 2008-D and Alloys 721 and 21 in deposited form. Hot hardness data are presented in Table 3. Values are the average of three test results. The data show that the hot hardness of the alloy of this invention is somewhat similar to Alloy 721 and superior to the cobalt-base Alloy 21.

TABLE 3

| HARDNESS DATA (Undiluted TIG Deposits) | Comparative Average Hot Hardness **DPH (Kg/mm²) | | | | | |
|---|---|---|---|---|---|---|
| | RT* | RT | 425° C. (800° F.) | 535° C. (1000° F.) | 650° C. (1200° F.) | 760° C. (1400° F.) |
| Alloy No. 21 | 20 | 235 | 150 | 145 | 135 | 115 |
| Alloy No. (2008-D) | 26 | 265 | 215 | 215 | 215 | 195 |
| Alloy No. 721 | 34 | 315 | 220 | 215 | 220 | 160 |

HARDNESS DATA (AS INVESTMENT CAST)

Diamond Pyramid Hardness Number

TABLE 3-continued

| | |
|---|---|
| Alloy No. 2 | 284 |

RT = Room Temperature
*Rockwell C Scale
**DPH = Diamond Pyramid Hardness - Tested in vacuum furnace of hot hardness units 1590 gram load, with 136 degree sapphire indenter.

Hardfacing deposition evaluations were made by the hardness values of deposits of the alloy of this invention and Alloy 21 as shown in Table 4. Deposits were made by the well-known TIG tungsten inert gas process and the manual metal arc process. Each value is the average of ten hardness tests taken by a standard Rockwell hardness unit.

The data show the hardfacing deposition hardness of the alloy of this invention to be somewhat similar to the cobalt-base Alloy 21.

TABLE 4

| | DEPOSIT HARDNESS Rockwell-B Scale | | | |
|---|---|---|---|---|
| | Single layer TIG* | Double layer TIG | Single layer MMA** | Double layer MMA |
| Alloy 21 | 100.1 | 104.7 | 99.0 | 99.6 |
| Alloy 2008 | 99.0 | 104.2 | 94.4 | 94.5 |

*TIG = Tungsten Inert Gas
**MMA = Manual Metal Arc

The alloy of this invention together with alloy 21 were tensile tested at room temperature and at high temperatures. Data are given in Table 5.

Alloy 2008-W (AR) identifies "as rolled" wrought product. Alloy 2008-W (SR) identifies "stress relieved" wrought product. The tensile properties are excellent, especially the elongation data of the wrought products.

TABLE 5

| | TENSILE PROPERTIES U.T.S. (HBAR)* TEST TEMPERATURE (C.) | | | | | | ELONGATION (%) TEST TEMPERATURE (C.) | | | | | |
|---|---|---|---|---|---|---|---|---|---|---|---|---|
| ALLOY | R. T. | 200 | 400 | 600 | 649 | 800 | R. T. | 200 | 400 | 600 | 649 | 800 |
| Alloy No. 21 | 86 | 77 | 66 | 60 | — | 58 | 9 | 15 | 11 | 13 | — | 26 |
| Alloy No. 2008-C | 70 | 58 | 53 | 51 | — | 41 | 7 | 10 | 16 | 16 | — | 32 |
| Alloy No. 2008-W (AR) | 104 | — | — | — | 67 | — | 23 | — | — | — | 11 | — |
| Alloy No. 2008-W (SR) | 88 | — | — | — | 61 | — | 38 | — | — | — | 32 | — |

*HECTOBAR

Wet corrosion data were obtained in a series of tests including prior art Alloys 21 and 721 and alloys of this invention, 2008-D and 2008-W. The specimens were exposed in 80% formic acid, 5% sulfuric acid, 65% nitric acid all at 66° C. and in 30% boiling acetic acid. The data show the alloy of this invention is generally as corrosion resistant as the prior art alloys. The corrosion data are presented in Table 6.

TABLE 6

| | CORROSION RESISTANCE - ACIDS Corrosion Rate - Mils per year, mpy | | | |
|---|---|---|---|---|
| | 80% Formic 66° C. | 30% Acetic Boiling | 5% Sulfuric 66° C. | 65% Nitric 66° C. |
| Alloy No. 21 | NIL | 3.46 | NIL | 3.08 |
| Alloy No. 2008-D | NIL | .38 | NIL | NIL |
| Alloy No. 721 | NIL | NIL | NIL | NIL |
| Alloy 2008-W | — | — | .025 | NIL |

Resistance to galling was measured on experimental alloys using procedures recently developed and described in Chemical Engineering 84 (10) (1977) pages 155 to 160 by W. J. Schumacher entitled "Wear and Galling can Knock Out Equipment".

In this test, 0.95 cm cylinders were loaded against a flat plate and rotated 360°. A ground surface finish (6–12 RMS) was used on both pin and plate. Fresh samples were used at each load tested. The load at which the first evidence of galling occurred was used to calculate the threshold galling stress. The galling data are reported in Table 7. In Table 7, the counterface alloys are 1020 mild steel, Alloy 316 stainless steel, nickel-base superalloy C-276 and cobalt-base superalloy No. 6. The data show the alloy of this invention has outstanding resistance to galling against the test alloys and against itself as the counterface.

TABLE 7

| | GALLING RESISTANCE Threshold Galling Stress - KG/MM$^2$ | | | | |
|---|---|---|---|---|---|
| | Self Counterface | 1020 Steel | 316 | C-276 | No. 6 |
| Alloy No. 21 | 50 | 13 | 13 | 13 | 50 |
| Alloy No. (2008-D) | 50 | 19 | 44 | 50 | 50 |
| Alloy No. 721 | 2 | 25 | 2 | — | 13 |

To determine the resistance of alloy 2008-D and comparative alloys to cavitation erosion, test discs of each material, polished to a 600-grit finish, were prepared. These discs were attached to the tip of an ultrasonic horn and tested in a vibratory cavitation erosion unit using ASTM G 32-77 standard testing procedures.

The specimen and approximately 13 mm of the horn tip were submerged in distilled water which was maintained at 27° C.±1° C. The specimen was cycled through an amplitude of 0.05 mm at a frequency of 20 KHz. Specimen weight loss was periodically measured (at approximately 25-hour intervals) and mean depth of erosion calculated.

The cavitation erosion test data shown in Table 8, reveal that the alloy of this invention has resistance to cavitation erosion comparable to the well known cobalt-base alloy No. 6B. Alloy 6B is known to have one of the most outstanding degree of resistance to cavitation erosion. The alloy nominally is comprised of about 30% chromium, 4.5% tungsten, 1.2% carbon, less than 3% each of nickel and iron, less than 2 to each of silicon and manganese, less than 1.5% molybdenum and the balance (about 60%) cobalt.

TABLE 8

| ALLOY | CAVITATION EROSION RESULTS TIME | MEAN DEPTH OF EROSION (mm)* |
|---|---|---|
| 2008-D Sample 1 | 25 | 0.0042 |
| | 50 | 0.0127 |
| | 75 | 0.0224 |
| | 100 | 0.0334 |
| 2008-D Sample 2 | 25 | 0.0079 |
| | 50 | 0.0212 |
| | 75 | 0.0349 |
| | 100 | 0.0492 |
| 6-B Sample 1 | 25 | 0.0016 |
| | 50 | 0.0091 |
| | 75 | 0.0205 |
| | 100 | 0.0415 |
| 6-B Sample 2 | 25 | 0.0067 |
| | 50 | 0.0164 |
| | 75 | 0.0278 |
| | 100 | 0.0401 |
| 721 | 25 | 0.0914 |
| | 61 | 0.1790 |
| | 86 | 0.2101 |
| | 107 | 0.2337 |

*mm — millimeter

What is claimed is:

1. An alloy having an outstanding combination of properties including metal to metal (galling) resistance, hot hardness, toughness, cavitation erosion and corrosion resistance and consisting essentially of, in percent by weight: 0.2 to 0.6 carbon, 25 to 36 cobalt, 3.5 to 10 nickel, 24 to 30 chromium, 1 to 5 tungsten plus molybdenum, 2 to 9 niobium plus tantalum, 0.5 to 2.0 silicon, up to 2.0 manganese, 55 minimum cobalt plus chromium, the total content of aluminum plus copper plus titanium plus vanadium plus zirconium plus hafnium not over 2, phosphorous not over 0.01, sulfur not over 0.01, boron up to 0.2 and the balance iron plus normal impurities wherein the ratio of niobium-to-chromium is within the range between 1 to 3.5 and 1 to 6.5 to provide said outstanding combination of properties and wherein said tantalum is optional in the alloy and is not considered in said niobium-to-chromium ratio.

2. The alloy of claim 1 wherein the chromium is 25 to 29, tungsten plus molybdenum is 1.5 to 5, niobium plus tantalum is 3 to 7, manganese is 0.45 to 1.5, the ratio of niobium-to-chromium is between 1 to 4 and 1 to 6, and the boron is up to 0.1.

3. The alloy of claim 1 wherein the carbon is about 0.4, cobalt is about 32, nickel is about 8, chromium is about 26.5, tungsten is about 2.5, niobium is about 5, silicon is about 1, manganese is about 1, cobalt plus chromium is about 58.5, the ratio of niobium-to-chromium is about 1 to 5, and iron plus normal impurities is about 23.

4. The alloy of claim 1 in the form of a casting or a wrought product or a metal powder or a material for hardfacing.

5. The alloy of claim 1 containing a minimal content of cobalt and strategic metals.

* * * * *